US007152324B2

(12) United States Patent
Uchiyama

(10) Patent No.: US 7,152,324 B2
(45) Date of Patent: Dec. 26, 2006

(54) ELECTRIC SHAVER

(75) Inventor: Hiromi Uchiyama, Matsumoto (JP)

(73) Assignee: Izumi Products Company, Nagano (JP)

( * ) Notice: Subject to any disclaimer, the term of this patent is extended or adjusted under 35 U.S.C. 154(b) by 338 days.

(21) Appl. No.: 10/786,740

(22) Filed: Feb. 25, 2004

(65) Prior Publication Data

US 2004/0163258 A1 Aug. 26, 2004

(30) Foreign Application Priority Data

Feb. 25, 2003 (JP) ..... 2003-046830

(51) Int. Cl.
*B26B 19/14* (2006.01)

(52) U.S. Cl. ..... 30/43.6; 30/43.1

(58) Field of Classification Search ..... 30/34.2, 30/43.4–43.6, 43.9, 43.92, 346.51, 43.1
See application file for complete search history.

(56) References Cited

U.S. PATENT DOCUMENTS 3,913,225 A * 10/1975 Tietjens et al. ..... 30/43.6
6,085,421 A 7/2000 Jorna et al.
6,769,179 B1 * 8/2004 Satoh et al. ..... 30/43.6
2002/0092173 A1 7/2002 Zuidervaart et al.

FOREIGN PATENT DOCUMENTS

DE 15 53 687 4/1971

* cited by examiner

*Primary Examiner*—Kenneth E. Peterson
*Assistant Examiner*—Sean M. Michalski
(74) *Attorney, Agent, or Firm*—Koda & Androlia

(57) ABSTRACT

An electric shaver including a cutter frame; an outer cutter disposed inside the cutter frame and is composed of a shaving surface having hair introduction openings, a side wall formed in continuous to the shaving surface, and corner slits formed in the side wall so as to communicate with the hair introduction openings; and an inner cutter having a plurality of inner cutter bodies that make sliding contact with an inside surface of the shaving surface of the outer cutter; wherein the electric shaver is provided with an upright member which is disposed between the side wall and side end surfaces of the inner cutter bodies that face the side wall and is disposed upright in a direction perpendicular to the shaving surface of the outer cutter. The tip end portion of upright member can protrude further toward the shaving surface than the end portions of the corner slits.

9 Claims, 13 Drawing Sheets

ELECTRIC SHAVER

BACKGROUND OF THE INVENTION

1. Field of the Invention

The present invention relates to an electric shaver and more particularly to an electric shaver equipped with outer cutters which have shaving surfaces having hair introduction openings therein.

2. Prior Art

In electric shavers, hair is introduced into outer cutters in which hair introduction openings are formed, and the hair that has been introduced into the areas inside the outer cutters is cut by inner cutters disposed inside the outer cutters.

"Hair" includes hair that is in an upright attitude and hair that is in a horizontal attitude. Hair that is in an upright attitude is easily introduced into the hair introduction openings, while hair that is in a horizontal attitude is difficult to introduce into the hair introduction openings; accordingly, hair in a horizontal attitude is a cause of residual shaving stubble. Conventionally, an electric shaver of the type shown in FIG. 13 has been proposed in order to solve this problem.

The electric shaver 100 shown in FIG. 13(*a*) is a rotary type electric shaver, and it comprises outer cutters 12, which have shaving surfaces 14 protruding from circular holes 23*a* formed in a cutter frame 23, and inner cutters 18, which are formed with a plurality of inner cutter bodies 16 that rotate while making sliding contact with the inside surfaces of the shaving surfaces 14.

The shaving surface 14 of each one of the outer cutters 12 installed in the electric shaver 100 is formed in a ring-form shape, and a plurality of slit-form hair introduction openings 15 that extend in the radial direction are formed in the shaving surface 14. In this outer cutter 12, outer circumference side corner slits 15*a*, which are formed in outside wall 12*b* disposed on the outer circumference side of the shaving surface 14, and inner circumference side corner slits 15*b*, which are formed in inside wall 34 disposed on the inner circumference side of the shaving surface 14, are disposed so that the respective corner slits communicate with the hair introduction openings 15.

As a result of the formation of the above-described outer circumference side corner slits 15*a* and inner circumference side corner slits 15*b* in each outer cutter 12, hair 50 that is in a horizontal attitude is efficiently introduced into the hair introduction openings 15. More specifically, when the shaving surface 14 is placed against the skin and moved along the skin, the root portion of hair 50 that is in a horizontal attitude enters the outer circumference side corner slits 15*a* and are introduced along the hair introduction openings 15 that extend rectilinearly, so that the hair is cut by the shaving surface 14 and the inner cutter bodies 16 (see FIG. 13(*b*)).

However, in cases where hair 50 that is in a horizontal attitude are introduced through the outer circumference side corner slits 15*a* and cut, the hair 50 that is in a horizontal attitude is introduced toward the centers of the hair introduction openings 15 while still in an inclined state (as seen from FIG. 13(*b*)); consequently, the hair is not cut as close to the root portion of the hair as it is in cases where hair in an upright attitude is cut, so that long portion of the hair remains.

Furthermore, other problems arise. When the electric shaver 100 constructed as described above is used on soft portions of the skin, there is a danger that the skin will be injured (i.e., that so-called shaver burn will occur). This shaver burn occurs in a manner that when the shaving surface 14 is placed against soft portions of the skin and moved along the skin, the soft skin intrudes into the areas inside the shaving surface 14 via the outer circumference side corner slits 15*a* or inner circumference side corner slits 15*b* of each outer cutter 12 and further slides along the shaving surface 14, so that the skin reaches the sliding positions of the inner cutter bodies 16 while still in this intruding state, thus causing the skin to be injured by the inner cutter bodies 16.

SUMMARY OF THE INVENTION

Accordingly, the present invention is to solve the above-described problems.

The object of the present invention is to provide an electric shaver that cuts hair which is in a horizontal attitude to a short length and makes it possible to shave hair in a favorable manner without injuring the skin in cases where the electric shaver is used on soft portions of the skin.

The above object is accomplished by a unique structure of the present invention for an electric shaver that includes: a cutter frame; an outer cutter which is provided in the cutter frame and is comprised of a shaving surface having slit-form hair introduction openings, a side wall formed in continuous to the shaving surface, and corner slits formed in the side wall to communicate with the hair introduction openings; and an inner cutter formed with a plurality of inner cutter bodies that make sliding contact with the inside surface of the shaving surface of the outer cutter; and in the electric shaver of the present invention, an upright member is provided between the side wall of the outer cutter and side end surfaces of the inner cutter bodies that face the side wall so that the upright member is in an upright attitude in a direction substantially perpendicular to the shaving surface of the outer cutter and is disposed so that the tip (upper) end portion of the upright member protrudes further toward the shaving surface than end portions of the corner slits.

In this structure, the upright member is provided on the outer cutter, so that the tip end portion of the upright member protrudes further toward the shaving surface than the end portions of the corner slits. As a result of this structure, the upright member acts in a manner that the tip end portion of the upright member closes the corner slits and pushes the skin that has intruded into the corner slits out toward the outer surfaces of the shaving surfaces. Thus, the upright member mainly prevents shaver burn.

Furthermore, the tip end portion of the upright member can be in contact with the inside surface of the shaving surface of the outer cutter. As a result, these upright member functions to prevent razor burn and raise hair into an upright attitude.

In addition, the tip end portion of the upright member is positinally adjustable in a direction that is perpendicular to the shaving surface or in a direction that is parallel to the side wall of the outer cutter. As a result, the amount of closure of the corner slits can be adjusted by the upright member, so that the effect in preventing shaver burn is appropriately adjusted.

Furthermore, the upright member is provided so as to be raised and lowered with respect to the outer cutter in a direction perpendicular to the shaving surface or in a direction parallel to the side wall of the outer cutter, and the tip end portion of the upright member protrudes further toward the shaving surface than the end portions of the corner slits when the upright member is raised. As a result, the position of the tip end portion of the upright member can be adjusted while the electric shaver is being used, so that the actions for preventing shaver burn and raising hair into an upright attitude can be appropriately set.

In addition, in the electric shaver of the present invention, the outer cutter and the inner cutter are disposed so as to float and thus be raised and lowered with respect to the cutter frame; and the upright member is disposed so that the tip end portion of the upright member is separated from the shaving surface of the outer cutter when the outer cutter is raised with respect to the cutter frame, and the tip end portion of the upright member is in contact with the inside surface of the shaving surface when the outer cutter is lowered with respect to the cutter frame. As a result, when the shaving surface of the electric shaver is lightly pressed against the skin, hair that is in a horizontal attitude and hair that is long are appropriately introduced through the corner slits; and when the shaving surface of the electric shaver is strongly pressed against the skin, the tip end portion of the upright member contact the inside surface of the shaving surface so that an action that raises the hair into an upright attitude is brought into play. Furthermore, in accordance with the strength of pressing, an effect that prevents shaver burn is also exhibited.

Furthermore, the upright member is attached to the outer cutter with an elastic member in between, and it is provided so that its tip end portion comes in contact with the inside surface of the shaving surface as a result of deformation of the elastic member that occurs when the outer cutter is lowered with respect to the cutter frame. Thus, in the present invention, the upright member can be raised and lowered by a simple structure.

In the above structure, the positional (raising and lowering) adjustment of the upright member can be designed so as to be accomplished in steps.

In the present invention, the outer cutter is comprised of a shaving surface formed in a ring-form shape, an outside wall formed in continuous to an outer circumferential edge of the shaving surface, an inside wall formed in continuous to an inner circumferential edge of the shaving surface, outer circumference side corner slits formed in the outside wall so as to communicate with the hair introduction openings, and inner circumference side corner slits formed in the inside wall so as to communicate with the hair introduction openings; and the upright member is disposed between the outside wall and outer circumference side end surfaces of the inner cutter bodies and/or between the inside wall and inner circumference side end surfaces of the inner cutter bodies.

DETAILED DESCRIPTION OF THE INVENTION

Preferred embodiments of the electric shaver of the present invention will be described in detail below with reference to the accompanying drawings.

Figure 1:
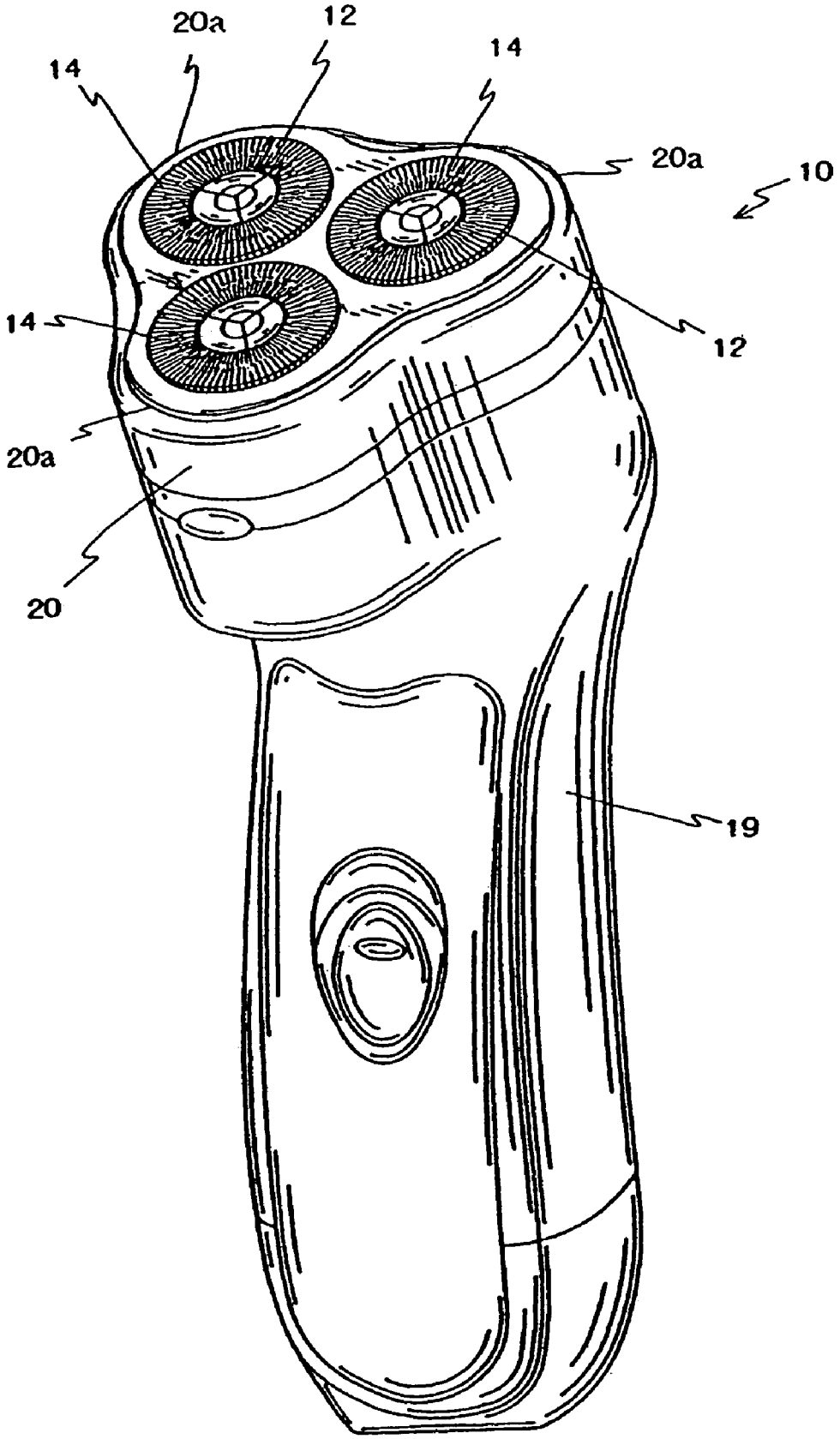
FIG. 1 shows an overall (external) construction of the electric shaver according to the present invention.

FIG. 1 shows one embodiment of the electric shaver of the present invention. As seen from FIG. 1, the electric shaver 10 of this embodiment is a rotary type electric shaver; and a cutter head 20 is detachably mounted on the upper part of a main body housing 19 of the shaver 10, and outer cutters 12 that have ring-form shaving surfaces 14 are attached to the cutter head 20. Three outer cutters 12 are installed in the cutter head 20, and these outer cutters 12 are disposed so that the centers of these outer cutters 12 are positioned at the vertices of a triangle.

In the shown embodiment, the electric shaver has three outer cutters 12 (and corresponding three inner cutters); however, the present invention applicable to an electric shaver that has one or two outer cutters 12 or four or more outer cutters 12.

Figure 2:
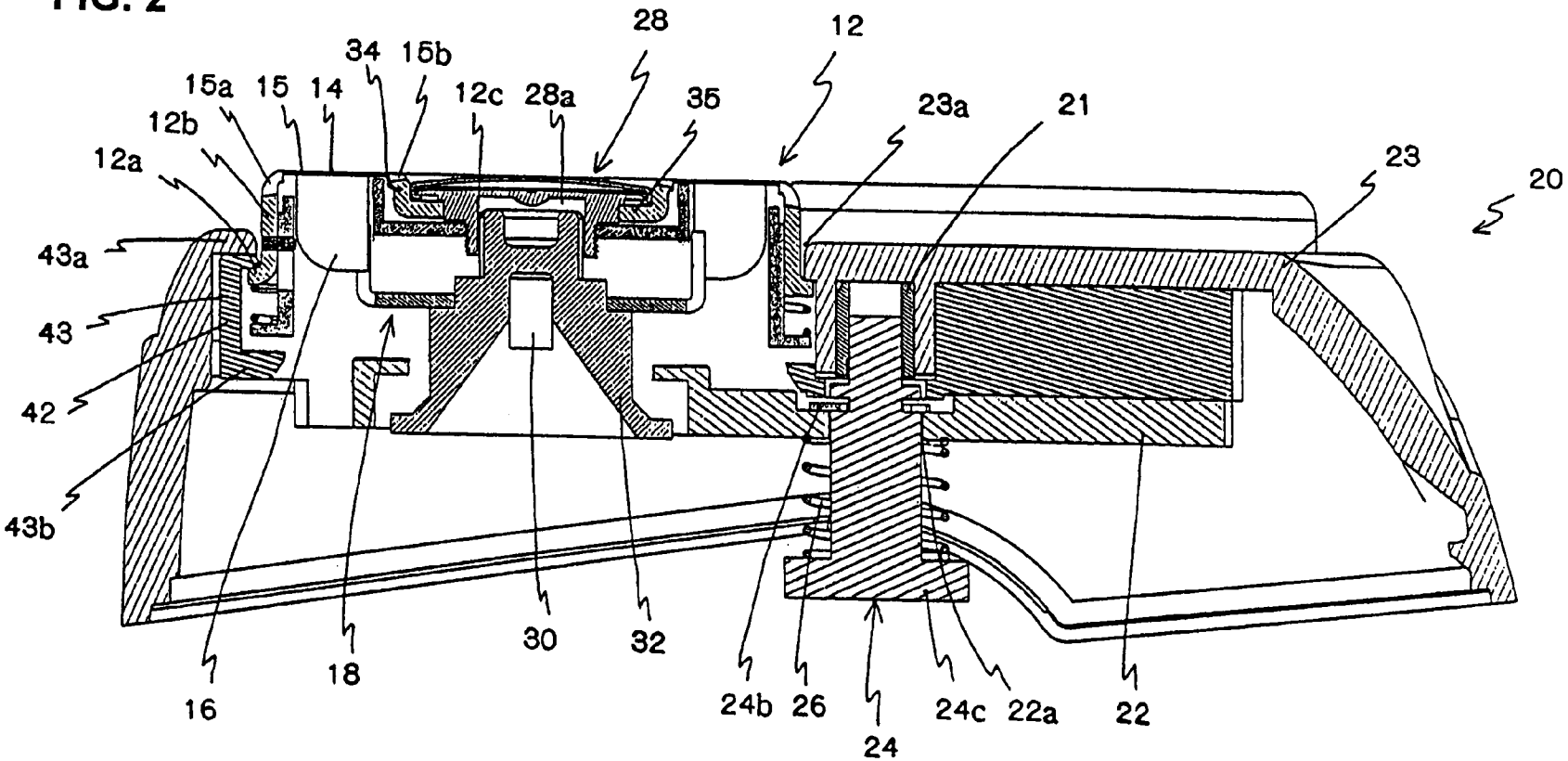
FIG. 2 is an enlarged sectional front view showing the inside of the cutter head of the electric shaver of FIG. 1.
Figure 3:
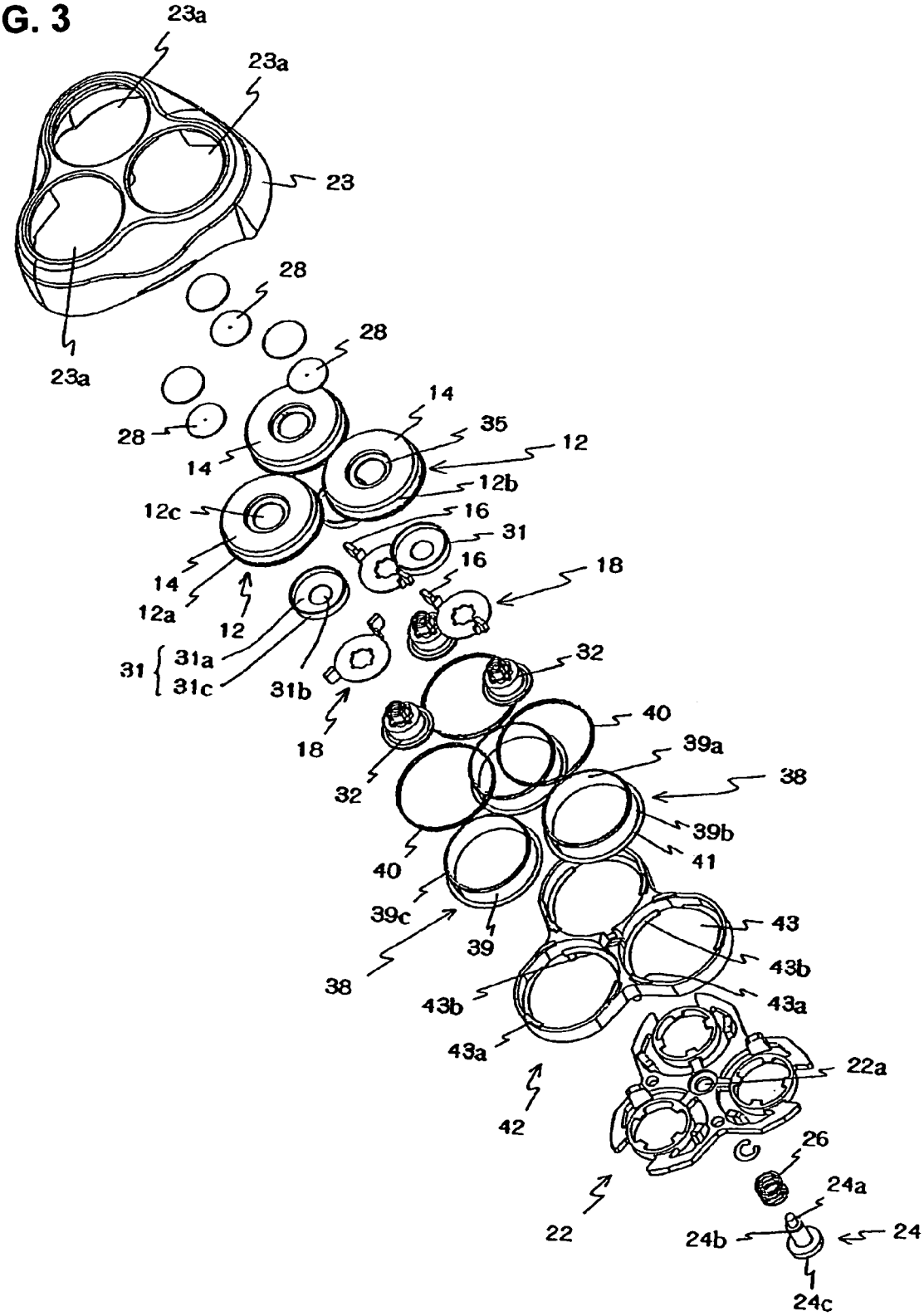
FIG. 3 is an exploded perspective view that shows the components installed inside the cutter head of the electric shaver of FIG. 1.

FIG. 2 is a sectional front view of the cutter head 20 of the electric shaver shown in FIG. 1, and FIG. 3 is an exploded perspective view of the cutter head 20 shown in FIG. 1.

As shown in FIGS. 2 and 3, the cutter frame 23 which is disposed on the upper portion of the cutter head 20 is in the shape of a cap whose upper surface is substantially triangular, and three circular holes 23*a* are formed in the upper surface of this cutter frame 23. An outer cutter supporting member 42 is attached to this cutter frame 23. The outer cutter supporting member 42 supports the outer cutters 12 so that the shaving surfaces 14 of the outer cutters 12 protrude from the circular holes 23*a*.

In the outer cutter supporting member 42, three ring portions 43 which are formed in the shape of rings with substantially the same diameter as the above-described circular holes 23*a* are formed as an integral unit. Upper stoppers 43*a* and lower stoppers 43*b* which protrude from the upper end edge and lower end edge on the inner circumference side are formed on the ring portions 43 of this outer cutter supporting member 42, and flanges 12*a* which are formed on the lower end edges of the outer cutters 12 are disposed between the upper stoppers 43*a* and lower stoppers 43*b*. In this way, the outer cutters 12 are disposed so as to be movable a specified distance in the direction perpendicular to the shaving surfaces 14.

As shown in FIG. 2, the outer cutters 12 supported on the outer cutter supporting member 42 are urged (via the inner cutters 18) by the biasing force of an inner cutter drive shaft 30 (installed in the main body housing of the shaver) in the direction that causes the shaving surfaces 14 to protrude. Ordinarily, therefore, the flanges 12*a* of the outer cutters 12 are in contact with the upper stoppers 43*a* of the outer cutter supporting member 42.

However, since the upper stoppers 43*a* of the outer cutter supporting member 42 in this embodiment are disposed at specified intervals along the upper end edges of the ring portions 43, the flanges 12*a* contact the inside surface of the cutter frame 23 in the areas where no upper stoppers 43*a* are disposed.

Each of the inner cutters 18 has a plurality of inner cutter bodies 16. Each of the inner cutter bodies 16 makes sliding contact with the inside surface of the ring-form shaving surface 14 of each of the outer cutters 12 and is fastened to the respective inner cutter bases 32. The tip end portion of each inner cutter base 32 is in the recessed portion 28*a* of outer cutter cap 28 which is mounted in the central hole 12*c* of the shaving surface 14, so that axial wobbling of the inner cutter 18 is prevented.

The inner cutter bases 32 to which the inner cutters 18 are fastened are supported so that the inner cutter bases 32 can rotate on a cutter cradle 22 and are engaged with the inner cutter drive shaft 30 so that the inner cutter bases 32 are caused to rotate.

The cutter cradle 22 that supports the inner cutter bases 32 is attached to the inside surface side of the cutter frame 23 by screw engagement of the external screw portion 24*a* of an attachment screw 24 disposed in the center of the cutter cradle 22 with an internal screw portion 21 disposed in the center of the cutter frame 23. The attachment screw 24 disposed in the cutter cradle 22 passes through a hole 22*a* formed in the cutter cradle 22 and is prevented from slipping out by a stopper 24*b*. In addition, the attachment screw 24 is provided with a resilient spring 26, which constantly applies a biasing force in the repelling direction, being interposed between the screw head 24*c* of the attachment screw 24 and the undersurface of the cutter cradle 22.

As a result of this construction, the cutter cradle 22 is disposed so as to be constantly urged upward (or toward the outer cutters 12) by the resilient spring 26, and the inner cutters 18 supported on the cutter cradle 22 and the outer cutters 12 supported by the pressing force of the inner cutters 18 are held in a manner that allows "floating" of these cutters with respect to the cutter frame 23.

Each of the outer cutters 12 is in a cap shape that is comprised of the ring-form shaving surface 14 and an outside wall 12*b* which is formed along the outer circumferential edge of the shaving surface 14. In the center of the shaving surface 14, an inside wall 34, which is disposed substantially parallel to the outside wall 12*b* on the inner circumferential edge of the ring-form shaving surface 14, and a ring surface 35, which is disposed on the end edge of the inside wall 34, are disposed.

Figure 13A:
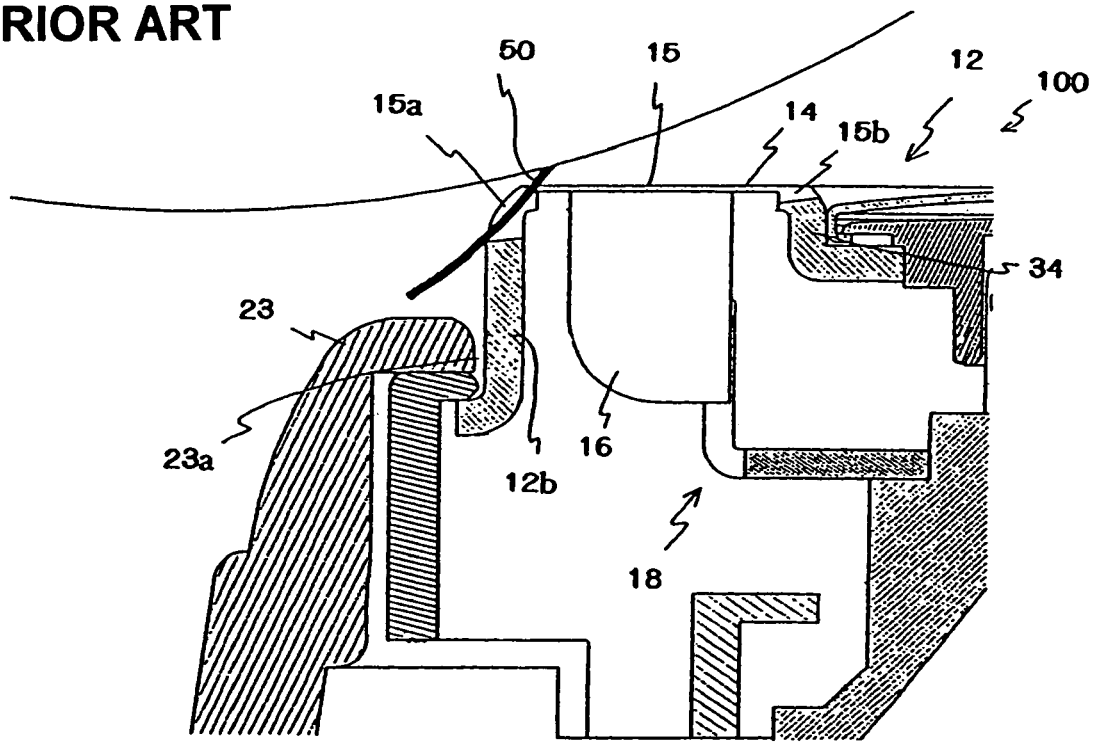
FIG. 13(a) PRIOR ART
FIGS. 13(*a*) and 13(*b*) illustrate the internal construction and action of a conventional electric shaver.
Figure 13B:
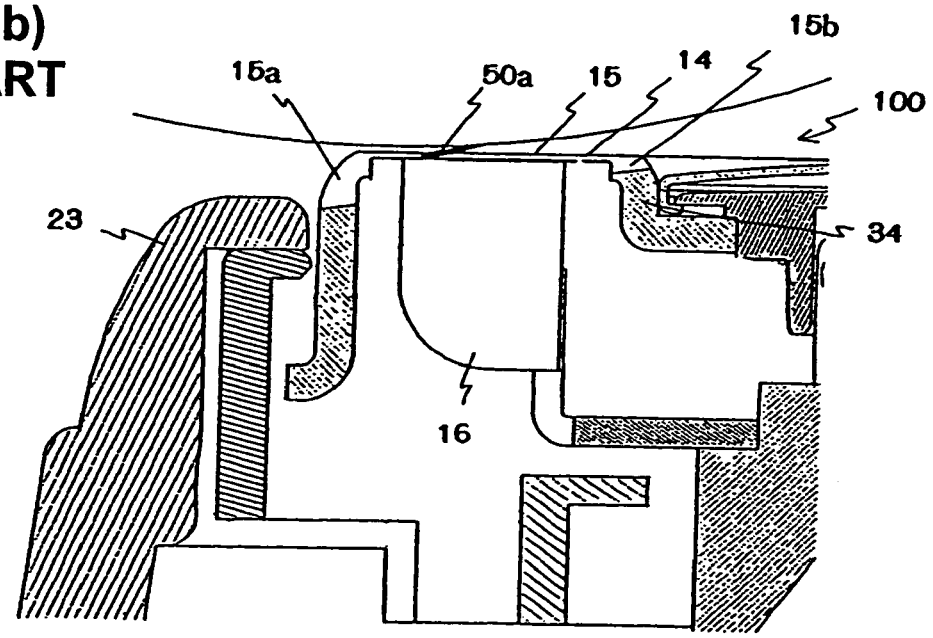
FIG. 13(b) PRIOR ART

A plurality of slit-form hair introduction openings 15 which extend in the radial direction are formed in the shaving surface 14 of each one of the outer cutter 12. Outer circumference side corner slits 15*a* and inner circumference side corner slits 15*b* are respectively formed in the outside wall 12*b* and inside wall 34 on the sides that are continuous to the shaving surface 14, and these corner slits are disposed so as to communicate with the hair introduction openings 15. As a result, hair that is in a horizontal attitude is easily introduced into the hair introduction openings 15. However, as seen from FIG. 13(*b*), problem arises; namely, when hair that is in a horizontal attitude is cut, the remaining hair is long compared to the cut length of hair in an upright attitude.

Accordingly, in the electric shaver 10 of the present invention, upright members which raise hair that is in a horizontal attitude are provided, and these members are disposed so that such hair can be reliably cut to a short length comparable to the cut length of hair that is in an upright attitude.

Furthermore, when hair on soft portions of the skin is cut as well, there is a danger that the skin will intrude through the outer circumference side corner slits 15*a* or inner circumference side corner slits 15*b* so that the skin is injured. In the electric shaver 10 of the present invention, however, the intrusion of the skin is prevented by the upright members so that shaver burn does not occur. The structure of the upright members will be described in detail below with reference to FIGS. 3 and 4.

Figure 4:
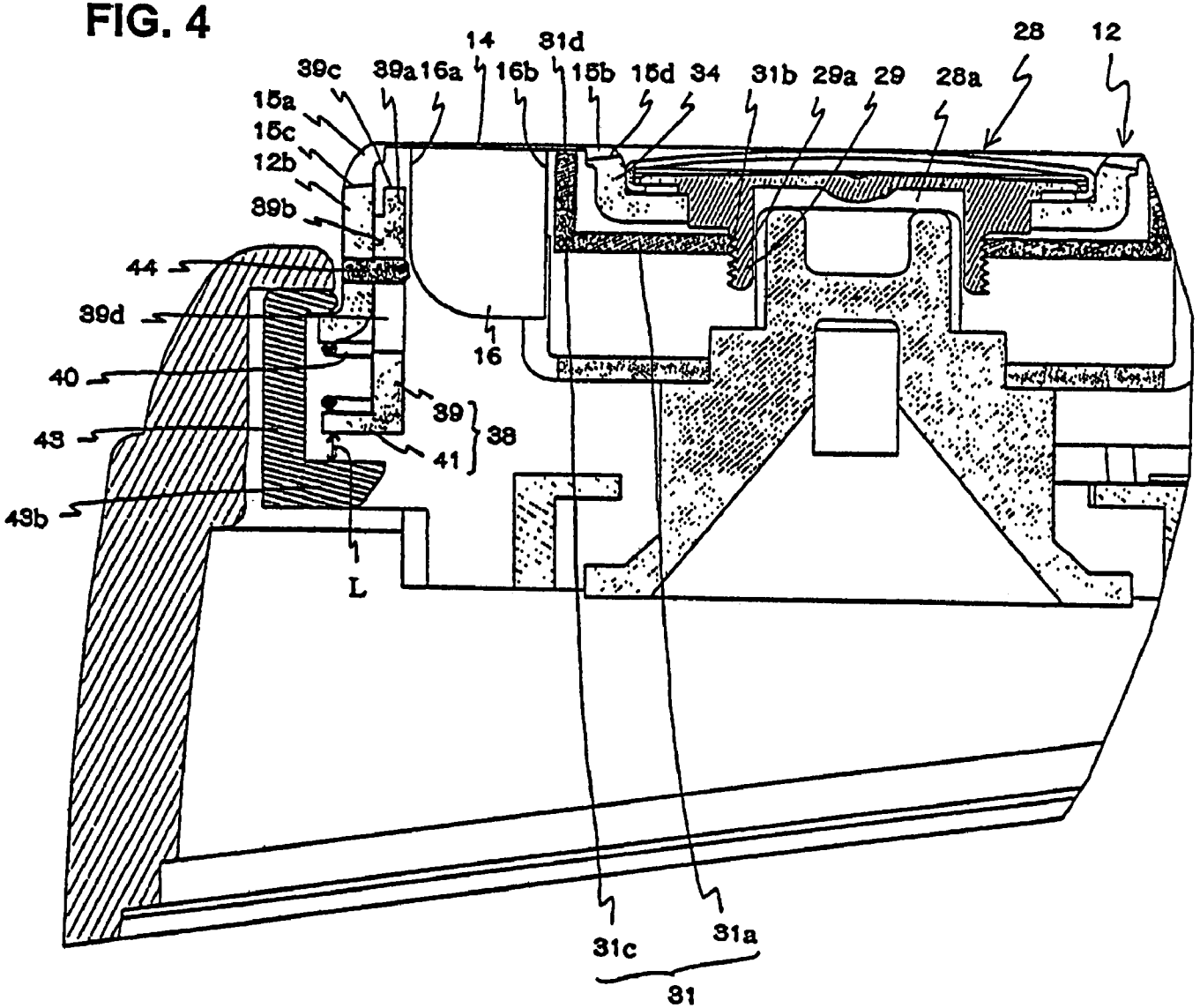
FIG. 4 is an enlarged sectional view of a part of the cutter head shown in FIG. 2.

As shown in FIGS. 3 and 4, a ring-form first upright member, which runs along the outside wall 12*b* of each one of the outer cutters 12 between the outside wall 12*b* and the outer circumference side end surfaces 16*a* of the inner cutter bodies 16 (of each inner cutter 18) that face the outside wall 12*b*, and a ring-form second upright member, which runs along the inside wall 34 of the outer cutter 12 between the inside wall 34 and the inner circumference side end surfaces 16*b* of the inner cutter bodies 16 (of each inner cutter 18) that face the inside wall 34, are disposed on the outer cutters 12. In the shown embodiment, the first upright member is provided as a hair raising member 38, and the second upright member is provided as a shaver burn preventing member 31.

The hair raising member 38 for each outer cutter 12 is disposed between the outside wall 12*b* of the outer cutter 12 and the outer circumference side end surfaces 16*a* of the inner cutter bodies 16; and it is comprised of an upright portion 39 and a bent portion 41. The upright portion 39 is formed in a ring-form shape that extends along the outside wall 12*b* of the outer cutter 12, and the bent portion 41 which is in a substantially L shape on the outer circumferential side from the lower end portion of the upright portion 39. More specifically, the upright portion 39 has such a thickness that the inside surface 39*a* of the ring-shaped upright portion 39 is in the vicinity of the inner cutter bodies 16 but is not in contact with the outer circumference side end surfaces 16*a* of the inner cutter bodies 16 and the outside surface 39*b* of the upright portion 39 is in contact with the inner circumferential surface of the outside wall 12*b* of the outer cutter 12.

The hair raising member 38 and each outer cutter 12 are formed into an integral unit by joining the upper surface of the bent portion 41 and the undersurface of the flange 12*a* of the outer cutter 12 by a coil spring 40 that is used as an elastic member. The hair raising member 38 that is formed as an integral unit with the outer cutter 12 is disposed so that the tip (upper) end portion 39*c* of the upright portion 39 of the hair raising member 38 approach the shaving surface 14 of each outer cutter 12 when the undersurface of the bent portion 41 is pushed upward (in the direction that causes the shaving surface 41 to protrude from the cutter flame 23), and the hair raising member 38 is provided so that the hair raising member 38 is raised and lowered with respect to the corresponding outer cutter 12.

The coil spring 40 that is disposed between the outer cutter 12 and the hair raising member 38 are provided so that one end of the coil spring 40 is joined to the undersurface of the flange 12*a* of the outer cutter 12, the spring is wound along the flange 12*a* of this outer cutter 12, and the lower end of the spring is joined to the upper surface of the bent portion 41 of the hair raising member 38. The coil spring 40 makes it possible to maintain the gap between the flange 12*a* of the outer cutter 12 and the bent portion 41 of the hair raising member 38 as substantially a uniform gap; accordingly, the upright portion 39 is substantially parallel to the outside wall 12*b* of the outer cutter 12.

In this embodiment, the coil spring 40 is in a shape in which the spring is wound along the flange 12*a* of the outer cutter 12. However, the present invention is not limited to this arrangement, and it is also possible to provide a plurality of coil springs of a size that can be carried on the upper surface of the bent portion 41 of the hair raising member 38 along the flange 12*a* of the outer cutter 12. Furthermore, the elastic member is not limited to coil springs, and it can be made of rubber, etc.

The hair raising member 38 that is integral to each of the outer cutters 12 is provided so that when the corresponding outer cutter 12 is in a floating state, i.e., a state in which no external pressure is being applied to the shaving surface 14 of the outer cutter 12, the tip end portion 39*c* of the upright portion 39 of hair raising member 38 is at substantially the same height position as the end portions 15*c* of the outer circumference side corner slits 15*a* formed in each of the outer cutters 12, and so that when the outer cutter 12 sinks, i.e., when external pressure is applied to the shaving surface 14 of the outer cutter 12, the tip end portion 39*c* of the upright portion 39 contacts the inside surface of the shaving surface 14.

More specifically, each of the lower stoppers 43*b* of the outer cutter supporting member 42 is positioned beneath the bent portion 41 of each of the hair raising member 38*s*; and when the outer cutter 12 sinks with respect to the cutter flame 23, the corresponding coil spring 40 deforms in the direction of compression as a result of the undersurface of the bent portion 41 contacting the upper surface of the lower stopper 43*b*, so that the tip end portion 39*c* of the upright portion 39 of the hair raising member 38 contact the inside surface of the shaving surface 14.

In this embodiment, the lower stoppers 43*b* are disposed in positions that are separated by a specified gap L (2 mm in this embodiment) from the undersurfaces of the bent portions 41 of the hair raising members 38. The lower stoppers 43*b* extend inward to such an extent that substantially the entire undersurfaces of the bent portions 41 make contact the upper surfaces of the lower stoppers 43*b* and are formed in a substantially ring-form shape (with partial cut-outs being formed (see FIG. 3)) along the lower end edges of the ring portions 43.

Furthermore, the corner portions of the outer cutters 12 are formed with an increased thickness in order to increase the rigidity of the shaving surfaces 14. Accordingly, the tip end portion 39*c* of the upright portion 39 of each one of the hair raising members 38 is formed in a shape in which the outer circumferential sides of the tip end portion 39*c* are cut out so that these tip end portions 39*c* do not contact the thick portions of the above-described corner portions.

Furthermore, a protruding pin 44 which protrude from the inner circumferential side of the outside wall 12*b* is attached to each one of the outer cutters 12, and the pin 44 engages with anchoring hole 39*d* formed in the side surface of the upright portion 39 of each hair raising member 38. The anchoring hole 39*d* of the upright portion 39 is formed as a slot whose direction of length is perpendicular to the shaving surface 14. As a result, each hair raising member 38 is disposed so as not to rotate in the circumferential direction but to be able to move a specified distance in the direction perpendicular to the shaving surface 14 or in the direction parallel to the above-described side walls. In other words, when the outer cutters 12 is moved upward or toward the shaving surface 14, the protruding pins 44 contact the upper end edges of the anchoring holes 39*d*, so that movement in the direction that separates the upright portions 39 from the shaving surfaces 14 is restricted, and when the outer cutters 12 is moved downward or in the direction opposite from the shaving surface 14, the positions of the pins 44 also drop so that the tip end portions 39*c* of the upright portions 39 approach the shaving surfaces 14 in relative terms.

Next, the state of the hair raising members 38 when pressure is applied to the shaving surfaces 14 of the outer cutters 12 will be described with reference to FIG. 5.

Figure 5A:
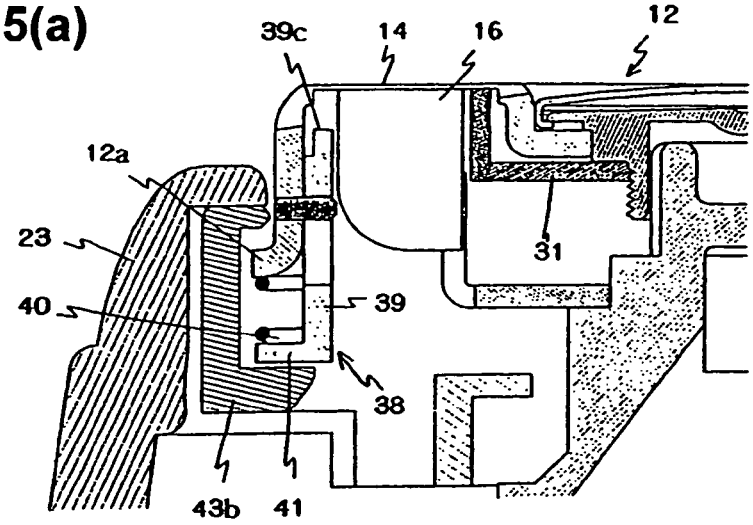
FIGS. 5(*a*), 5(*b*) and 5(*c*) are explanatory diagrams showing the successive operations of the hair raising member shown in FIG. 2.
Figure 5B:
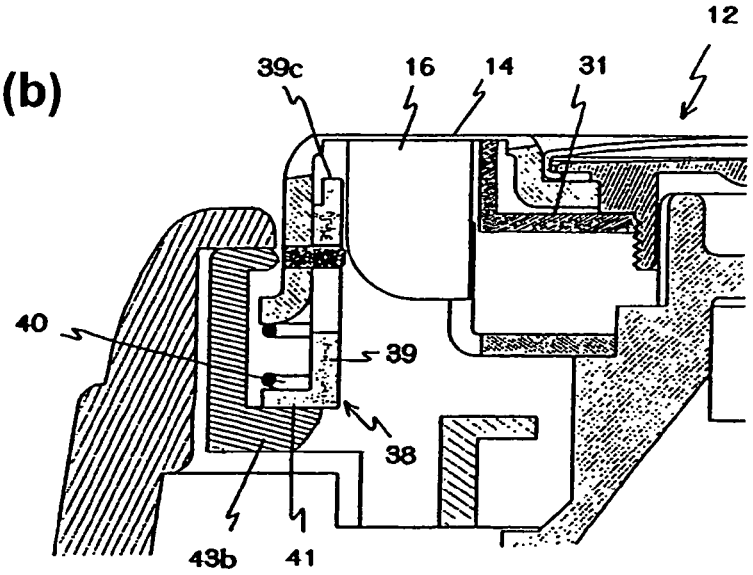
Figure 5C:
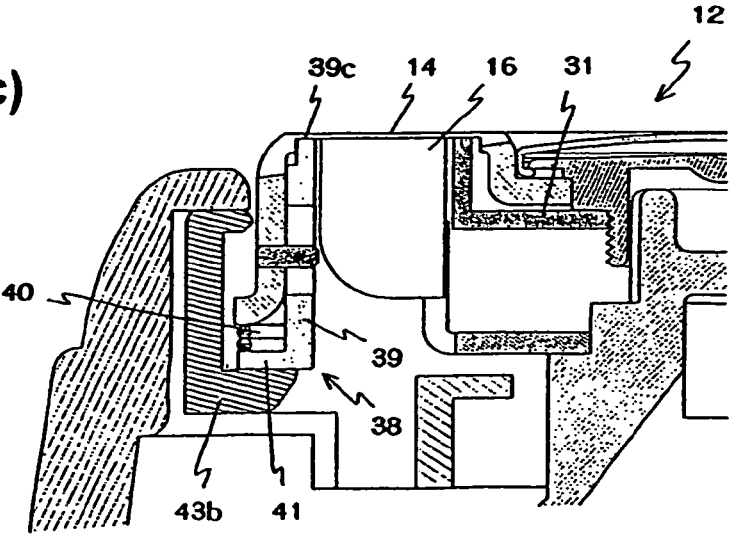

As shown in FIG. 5(*a*), when pressure is applied to the shaving surface 14 of each one of the outer cutters 12, a resilient spring (not shown) that supports the cutter cradle 22 is compressed so that the outer cutter 12 sink with respect to the cutter frame 23. In this case, the corresponding hair raising member 38 drops while being attached to the outer cutter 12. Then, when the outer cutter 12 sinks by an amount that corresponds to the gap L, the undersurface of the bent portion 41 of the hair raising member 38 contacts the upper surface of the lower stopper 43*b* as shown in FIG. 5(*b*).

After the bent portion 41 has contacted the lower stopper 43*b*, the outer cutter 12 sinks further as a result of the flange 12*a* pressing the coil spring 40. In this case, as each of the outer cutters 12 sinks, the tip end portion 39*c* of the corresponding hair raising member 38 gradually approaches the shaving surface 14 in relative terms, and the tip end portion 39*c* contacts the inside surface of the shaving surface 14 of the outer cutter 12 as shown in FIG. 5(*c*).

In the electric shaver 10 equipped with hair raising members 38 that act as described above, the tip end portion 39*c* of each hair raising member 38 contacts the inside surface of the shaving surface 14 of the corresponding outer cutter 12 as a result of the shaving surface 14 being pressed strongly against the skin when hair is shaved, so that hair in a horizontal attitude is cut to a short length in the same manner as when hair in an upright attitude is cut. The cutting operation that is performed in cases where hair in a horizontal attitude is cut will be described in order with reference to FIGS. 6 and 7.

When hair is shaved by means of an electric shaver, the shaving surface of the electric shaver is first moved along the skin 48 while being lightly pressed against the skin, after which the shaver is moved back and forth reciprocally over the same area several times while the force with which the shaving surface is pressed against the skin is gradually increased. Accordingly, shaving performed by this procedure will be described below.

Figure 6A:
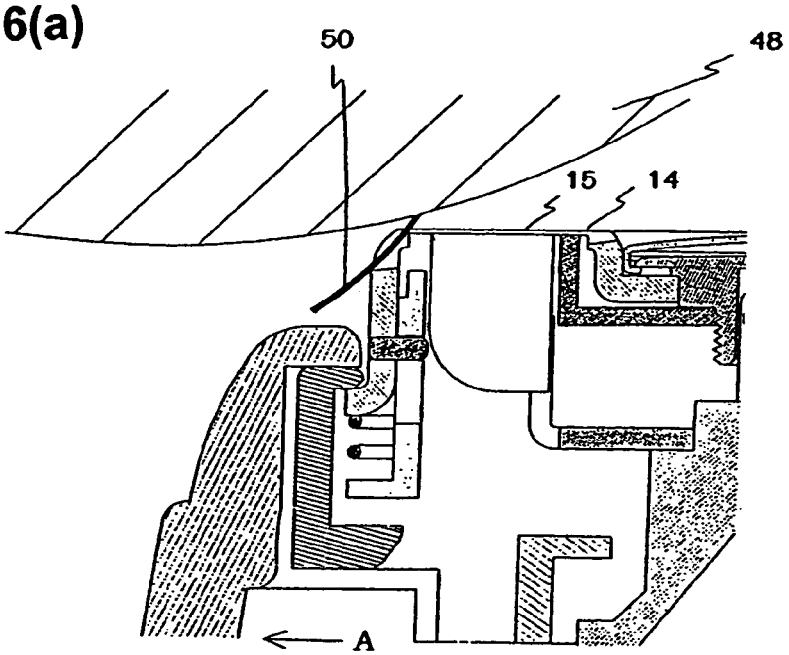
FIGS. 6(*a*), 6(*b*) and 6(*c*) show the manner of cutting the hair using the electric shaver of the present invention.
Figure 6B:
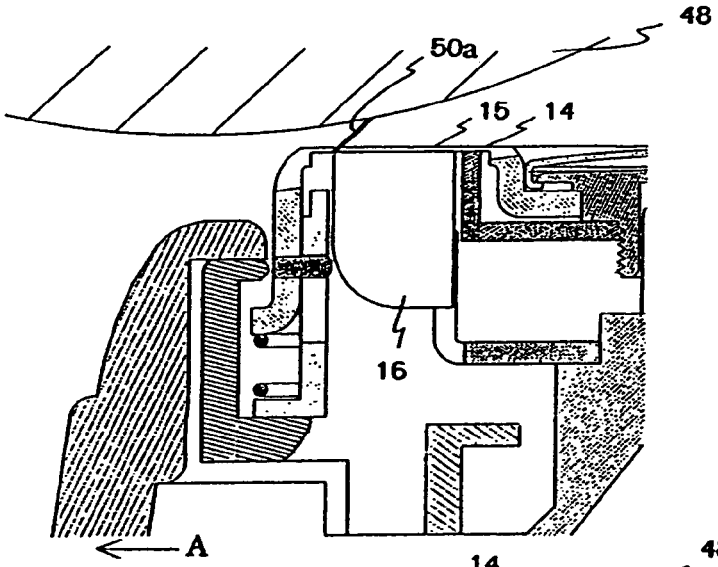
Figure 6C:
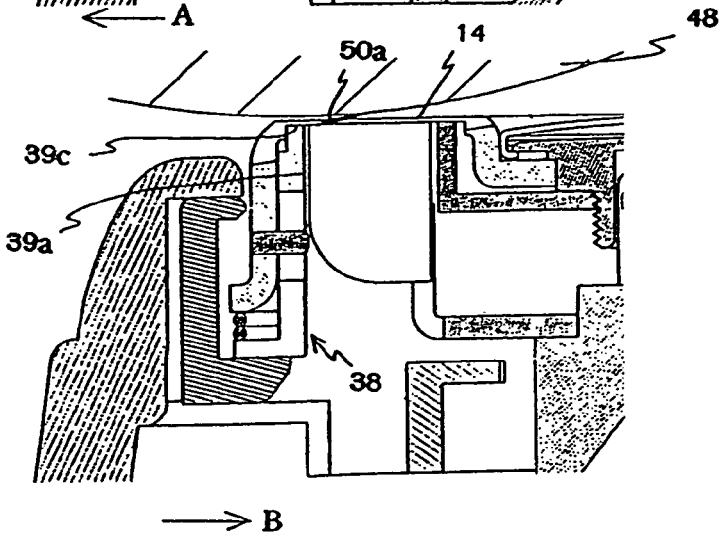

As shown in FIG. 6(*a*), when the electric shaver is moved in the direction of arrow A (i.e., in the same direction as the inclination of the hair 50) while the shaving surface 14 of each outer cutter 12 is pressed lightly against the skin 48, the root portion of the hair 50 in an inclined attitude enters the outer circumference side corner slit 15*a* and is introduced while being oriented in the direction of length of the hair introduction opening 15. When the hair is introduced to the inside of the shaving surface 14, the hair is cut by the shaving surface 14 and inner cutter bodies 16 as shown in FIG. 6(*b*). In this case, as described above, the hair 50*a* is left at a longer length than in cases where hair in an upright attitude is cut.

Accordingly, in the present invention, as seen from FIG. 6(*c*), when the shaving surface 14 is pressed strongly against the skin 48, and the electric shaver is moved in the direction of arrow B (the opposite direction from the direction of arrow A) so that the tip end portion 39*c* of the hair raising member 38 contacts the inside surface of the shaving surface 14 (i.e., in the state shown in FIG. 5(*c*)), the hair 50*a* is cut to a short length.

Figure 7A:
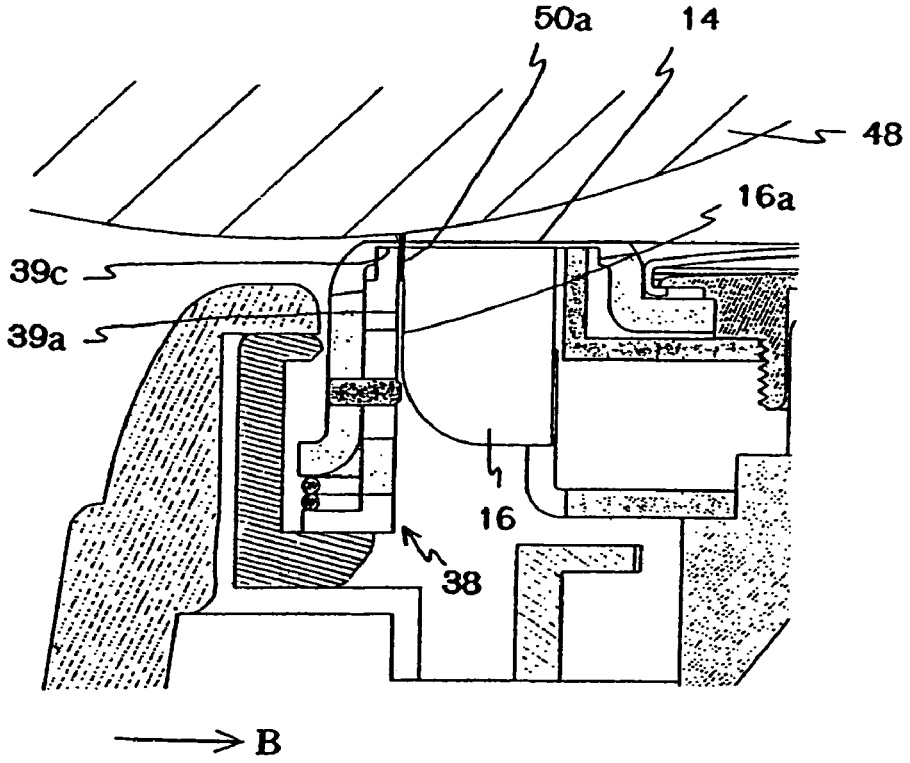
FIGS. 7(*a*) and 7(*b*) show the manner of cutting the hair using the electric shaver of the present invention.
Figure 7B:
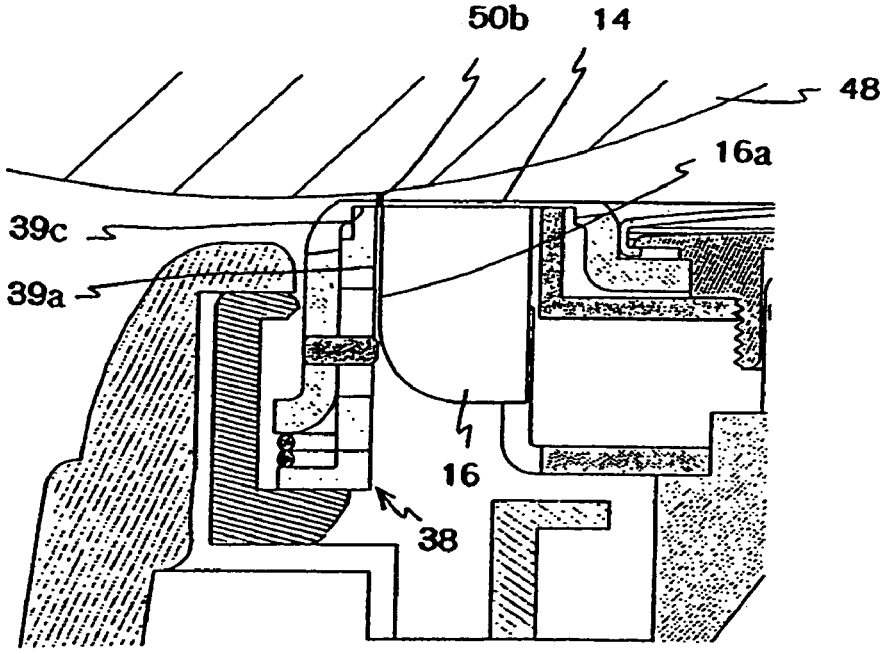

More specifically, when the electric shaver 10 is moved in the direction of arrow B from the state shown in FIG. 6(*c*), the tip end of the cut hair 50*a* contacts the inside surface 39*a* of the hair raising member 38, and when the electric shaver 10 is moved further in the direction of arrow B, the hair enter in the downward direction along the inside surface 39*a*, so that the hair is placed in an upright attitude (FIG. 7(*a*)).

Then, since the inside surface 39*a* of the hair raising member 38 is disposed so as to be located in the vicinity of the outer circumference side end surfaces 16*a* of the inner cutter bodies 16, the hair 50*a* is immediately cut by the inner cutter bodies 16 (FIG. 7(*b*)). As a result, since the hair 50*b* is cut in an upright attitude, the hair is cut to a short length that is substantially comparable to the cut length that is obtained in cases where hair in an upright attitude is cut.

Figure 8A:
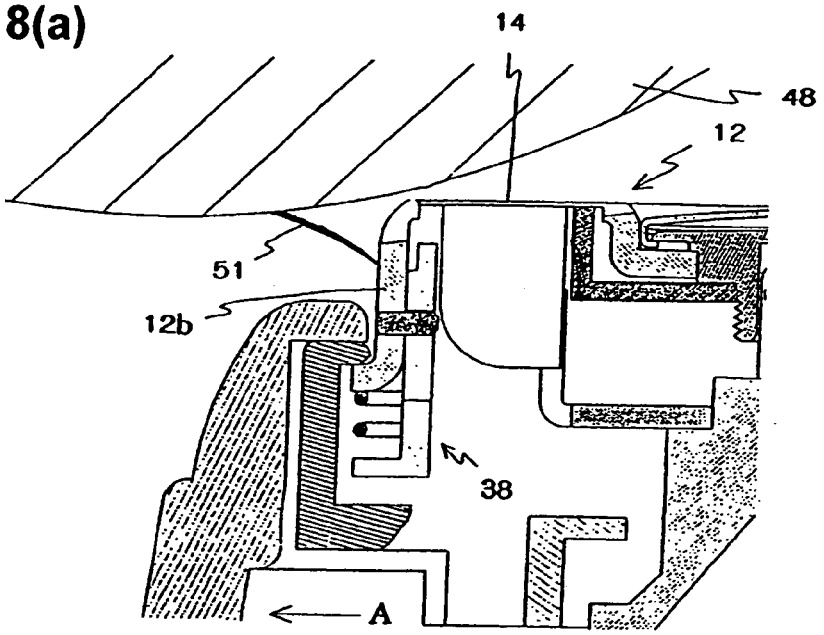
FIGS. 8(*a*), 8(*b*) and 8(*c*) show the manner of cutting the hair using the electric shaver of the present invention.
Figure 8B:
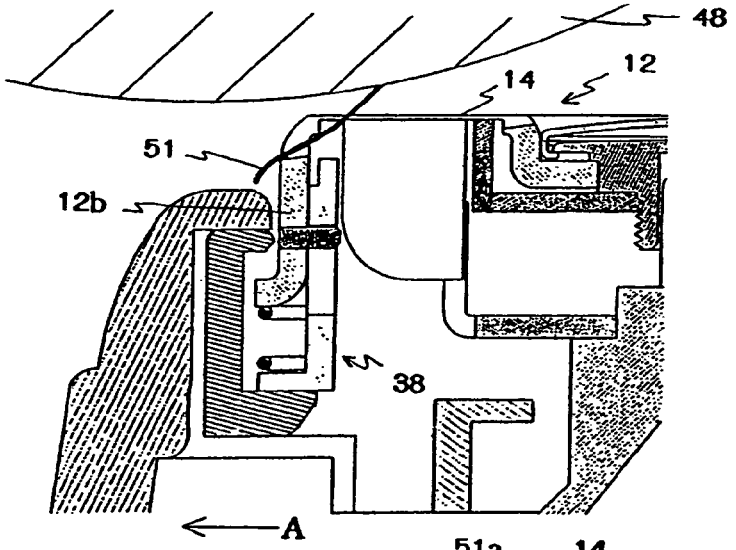
Figure 8C:
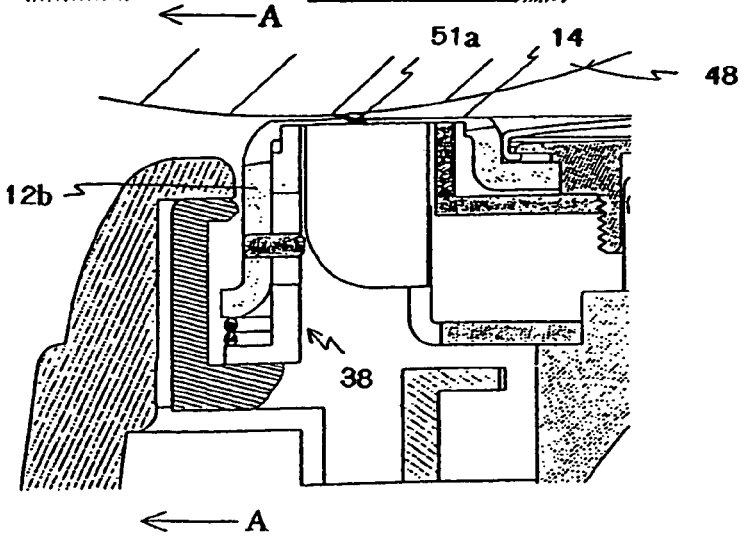
Figure 9A:
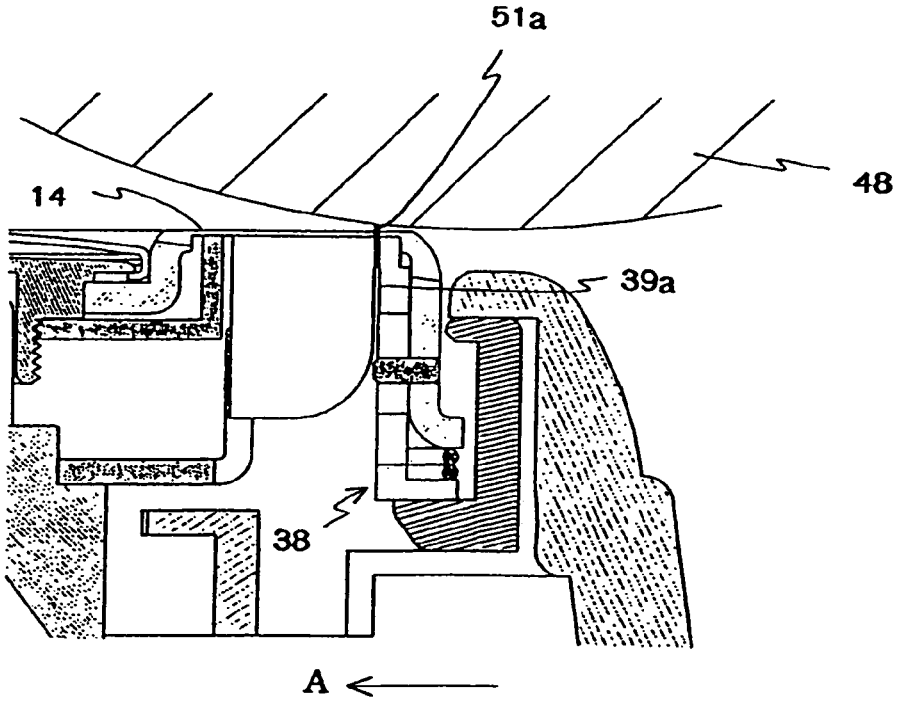
FIGS. 9(*a*) and 9(*b*) show the manner of cutting the hair using the electric shaver of the present invention.
Figure 9B:
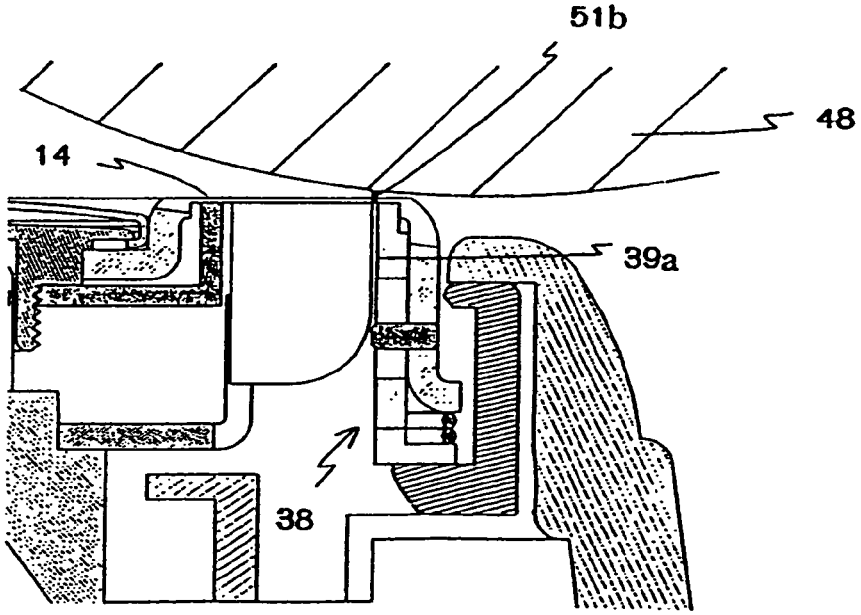

In cases where hair 51 in a horizontal attitude that is oriented in the opposite direction from the hair 50 is cut will be next described. When the electric shaver 10 is first moved in the direction of arrow A (i.e., in the opposite direction from the inclination of the hair 51) as shown in FIG. 8(*a*), the tip end of the hair 51 contacts the outside wall 12*b* of the outer cutter 12, so that the hair is introduced toward the center while being inclined in the opposite direction (FIG. 8(*b*)) and is cut. As seen from FIG. 8(*c*), the cut hair 51*a* assumes a state in which the hair is inclined in the initial direction of inclination. Accordingly, even if the electric shaver 10 is moved in the direction of arrow B (i.e., the opposite direction from the direction of arrow A) as shown in FIG. 6(*c*), the tip end portion of the hair 51*a* does not contact the hair raising members 38 and therefore cannot be raised into an upright position. However, if the shaving surface 14 is moved "as is" in the direction of arrow A, the tip end of the hair 51*a* will contact the hair raising member 38 in symmetrical positions with respect to the center of the outer cutter 12 (i.e., in position that is opposite the cutting position in the shaving surface 14), so that the hair is raised (FIG. 9(*a*)). Then, the hair is cut by the inner cutter bodies 16 located on the inside surface 39*a* of the hair raising member 38, and the hair 51*b* becomes at a length comparable to the thickness of the shaving surfaces 14 (FIG. 9(*b*)).

In the above embodiment, the upright members act as hair raising members in which the tip end portions of the upright members contact the inside surfaces of the shaving surfaces. However, the present invention is not limited to such an arrangement; and the upright members can also act as hair raising members even in a state in which the tip end portions of the upright members are separated from the inside surfaces of the shaving surfaces.

Next, the construction of the shaver burn preventing members 31 that are installed as second upright members will be described.

The shaver burn preventing members 31 in this embodiment are disposed so that they are provided by being screw-engaged with screw portions 29*a* formed on the outer circumferential surfaces of the side walls 29 that surround the recessed portions 28*a* of the outer cutter caps 28.

As shown in FIG. 3, each shaver burn preventing member 31 is comprised of a circular disk portion 31*a*, which has a screw engagement hole 31*b* (that is screw-engaged with the screw portion 29*a* of the outer cutter cap 28) formed in the center of this disk part, and a ring-form upright portion 31*c*, which rises from the outer circumferential edge of the circular disk portion 31*a* in the direction substantially perpendicular to the shaving surface 14 of the corresponding outer cutter 12.

The upright portion 31*c* of each one of the shaver burn preventing members 31 that are attached by screw engagement with the screw portions 29*a* of the corresponding outer cutter caps 28 is disposed in the vicinity of the inner circumference side end surfaces 16*b* of the inner cutter bodies 16, and these shaver burn preventing members 31 are provided so that the tip end portions 31*d* thereof are positioned higher than the end portions 15*d* of the inner circumference side corner slits 15*b* of the corresponding outer cutters 12 so that the tip end portions 31*d* close off the inner circumference side corner slits 15*b*.

Since the shaver burn preventing members 31 are attached to the outer cutter caps 28, the positions of the tip end portions 31*d* remain fixed with respect to the outer cutters 12 even in a state in which the outer cutters 12 sink with respect to the cutter frame 23. Thus, the shaver burn preventing members 31 can always exhibit a shaver burn preventing effect.

The height of each one of the shaver burn preventing members 31 can be adjusted in the direction perpendicular to the shaving surface 14 of the corresponding outer cutter 12 by adjusting the amount of screw engagement between the screw engagement hole 31*b* of the circular disk portion 31*a* and the corresponding screw portion 29*a* of the outer cutter cap 28, the positions of the tip end portion 31*d* of the respective shaver burn preventing members 31 can be appropriately adjusted; and in cases where the shaver burn preventing members 31 are not used, they can be provided so that the tip end portions 31*d* are positioned lower than the end portions 15*d* of the inner circumference side corner slits 15*b*.

In the shown embodiment, the shaver burn preventing members 31 are provided so as to be adjusted in the height direction with respect to the outer cutters 12. However, the shaver burn preventing members 31 can act as the above-described hair raising members when they are disposed in place so that the tip end portions 31*d* thereof are in contact with the inside surfaces of the shaving surfaces 14.

The above-described shaver burn preventing members 31 are provided in order to prevent injury to the skin when the electric shaver 10 is used on soft portions of the skin. More specifically, in cases where hair located on soft portions of the skin is shaved, when the shaving surfaces 14 are caused to slide along the skin, portions of the skin would intrude via the inner circumference side corner slits 15*b*; however, since shaver burn preventing members 31 that close off the inner circumference side corner slits 15*b* by means of the tip end portions 31*d* of their upright portions 31*c* are provided, the intruding skin is guided to the outside of the shaving surfaces 14 by the tip end portions 31*d* of the upright portions 31*c*, and the skin is prevented from being introduced into the sliding positions of the inner cutter bodies 16, so that injury of the skin would not occur.

Figure 10A:
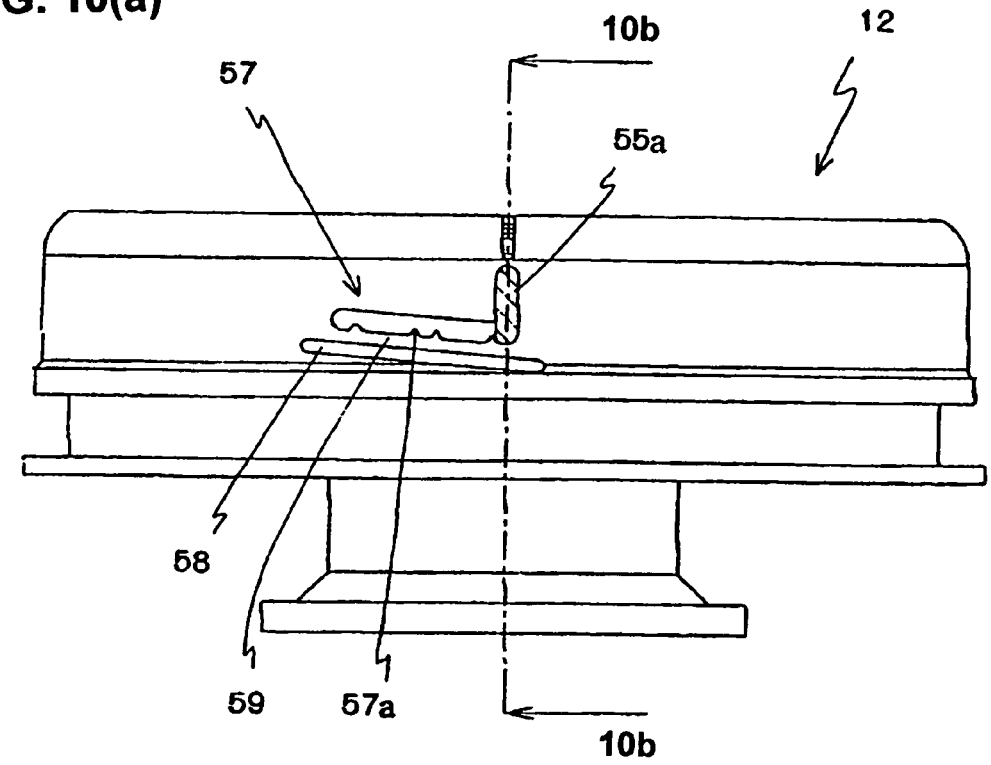
FIG. 10(*a*) shows a side view of the outer cutter according to a modification of the electric shaver of the present invention, FIG. 10(*b*) showing its cross-section taken along the lines 10*b*—10*b* in FIG. 10(*a*)
Figure 10B:
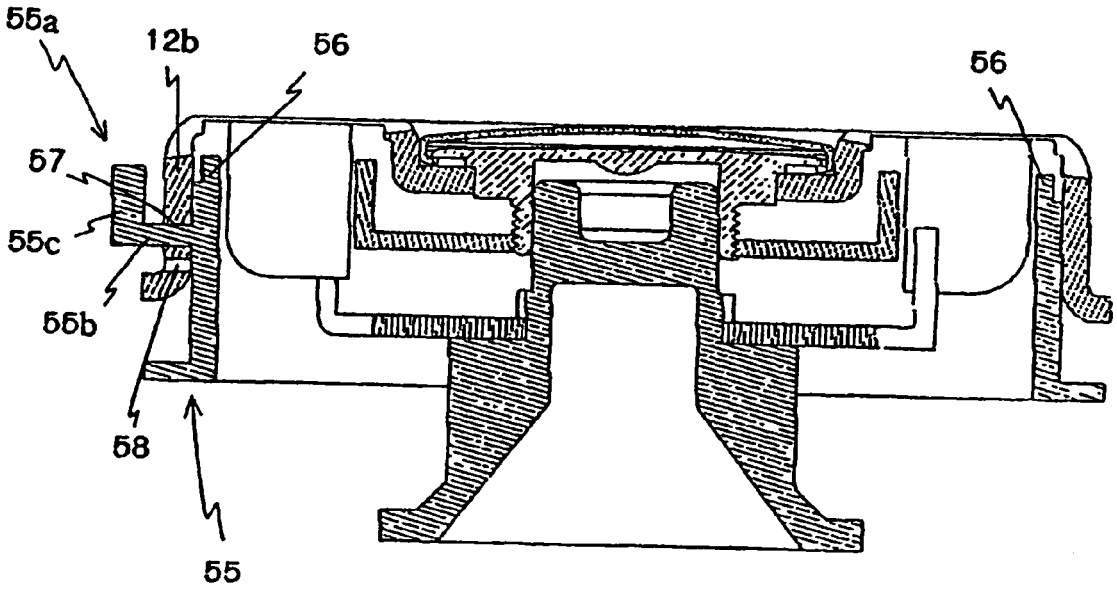

FIG. 10(*a*) shows a modification of the electric shaver of the present invention and FIG. 10(*b*) shows its cross-section.

As seen from FIG. 10(*a*), a knob 55*a* on the upright member 55 is disposed so as to protrude outward from the outside wall 12*b* of the outer cutter 12. As shown in FIG. 10(*b*), the knob 55*a* is comprised of a protruding portion 55*b* and a knob portion 55*c*. The protruding portion 55*b* protrudes in the direction perpendicular to the corresponding outside wall 12*b* from the outer circumferential surface of a ring-form upright portion 56 that is disposed in an upright position along the outside wall 12*b*, and the knob portion

55*c* is bent upward from the outer end of the protruding portion 55*b*. The knob 55*a* protrudes from the slide hole 57 formed in the outer cutter 12.

As shown in FIG. 10(*a*), a slide hole 57 that is formed in the outside wall 12*b* of the outer cutter 12 is formed so as to be slightly inclined with respect to the surface of the flange 12*a* of the outer cutter 12. Accordingly, when the knob portion 55*c* of each of the upright members 55 is caused to slide along the corresponding slide hole 57, the position of the tip end portion 56*a* of the upright portion 56 is moved upward or downward in the direction perpendicular to the shaving surface 14 while the upright member 55 rotates, so that a positional adjustment is performed. Furthermore, since the knob 55*a* that allows the positional adjustment of the tip end portion of the upright member 55 are disposed on the outside of the outer cutter 12, this positional adjustment can be performed quickly and easily.

Projections 57*a* are formed at arbitrary intervals at the lower end of each slide hole 57. When the knob 55*a* is caused to slide, these projections anchor the protruding portion 55*b* of the upright member 55 and maintain the positions of the upright member 55. The tip end portion 56*a* of each upright member 55 can be adjusted for different positions in steps.

In the embodiment shown in FIGS. 10(*a*) and 10(*b*), a slit 58 is formed beneath the slide holes 57 so as to be substantially parallel with the slide hole 57. As a result, a band portion 59 which is between the slide hole 57 and the slit 58 is flexible, and thus the protruding portion 55*b* of the upright member 55 can easily ride over the projections 57*a* in the slide hole 57 when the upright member 55 is caused to slide, so that the operation of the above-described adjustment in steps can be favorably performed.

In the above description, the hair raising members 38 and the shaver burn preventing members 31 that constitute upright members are formed in a ring-form shape along the outside walls 12*b* of the outer cutters 12. However, the present invention is not limited to this arrangement, and these elements can be formed in a circular arc shape (constituting portions of a ring-form shape) along the outside wall 12*b* or inside wall 34 of each outer cutter 12.

For instance, instead of the ring-form hair raising members 38, it is also possible to use a hair raising member 38 that has a semicircular arch shaped upright portion 39, so that this semicircular arch shaped upright portion 39 is disposed outer side of each one of the outer cutters 12 that is near the corner portion 20*a* (see FIG. 1) of the upper surface of the cutter head 20. In this hair raising member 38 that has a semicircular arch shaped upright portion 39, since the outer cutter's outer side that is near the corner portion 20*a* can sink easily with respect to the cutter frame 23, the tip (upper) end portion 39*c* of the semicircular arch shaped upright portion 39 of each of the hair raising members 38 contact the inside surface of the shaving surface 14 of the corresponding outer cutter so that a favorable hair raising action is insured. On the other hand, in this hair raising member 38 that has a semicircular arch shaped upright portion 39, since no upright portion is formed on the opposite side from the semicircular arch shaped upright portion 39, hair is easily introduced through the outer circumference side corner slits 15*a* into the outer cutters 12 on the outer cutter's inner side that is the far side from the corner portion 20*a*.

In the shown embodiment, the hair raising members 38 that constitute the upright members are disposed on the outer circumferential sides of the inner cutter bodies 16, and the shaver burn preventing members 31 that constitute also the upright members are disposed on the inner circumferential sides of the inner cutter bodies 16. However, the present invention is not limited to this arrangement; and it is also possible to dispose the hair raising members on the inner circumferential sides of the inner cutter bodies 16 and to dispose the shaver burn preventing members on the outer circumferential sides of the inner cutter bodies 16. Furthermore, upright members that have the same effect can be disposed on both the inner circumferential sides and outer circumferential sides of the inner cutter members 16, and the upright members can be disposed on only the inner circumferential sides or outer circumferential sides of the inner cutter bodies 16.

The hair raising members of the present invention are not those members that have only a hair raising effect; and these members also have the effect of preventing shaver burn as a result of being positioned higher than the end portions of the corner slits. On the other hand, the shaver burn preventing members likewise have not only a shaver burn preventing effect but also a hair raising effect when the tip end portions thereof are positioned in the vicinity of the inside surfaces of the shaving surfaces.

In the shown embodiment, the positions of the tip end portions 39*c* of the hair raising members 38 when the outer cutters 12 are in the floating state are at substantially the same height as the end portions 15*c* of the outer circumference side corner slits 15*a*. However, in the present invention, it is also possible to provide these elements so that the tip end portions 39*c* of the hair raising members 38 are lower than the end portions 15*c* of the outer circumference side corner slits 15*a*, or the hair raising members 38 can be provided so that the tip end portions 39*c* always protrude further toward the shaving surfaces 14 than the end portions 15*c* of the outer circumference side corner slits 15*a*.

Furthermore, in the shown embodiment, each outer cutter has a single shaving surface 14 that is in a ring-form shape (thus being a single track cutter); however, in the electric shaver of the present invention, the outer cutters can be of a multiple-track and have two or more annular shaving surfaces 14.

Figure 11:
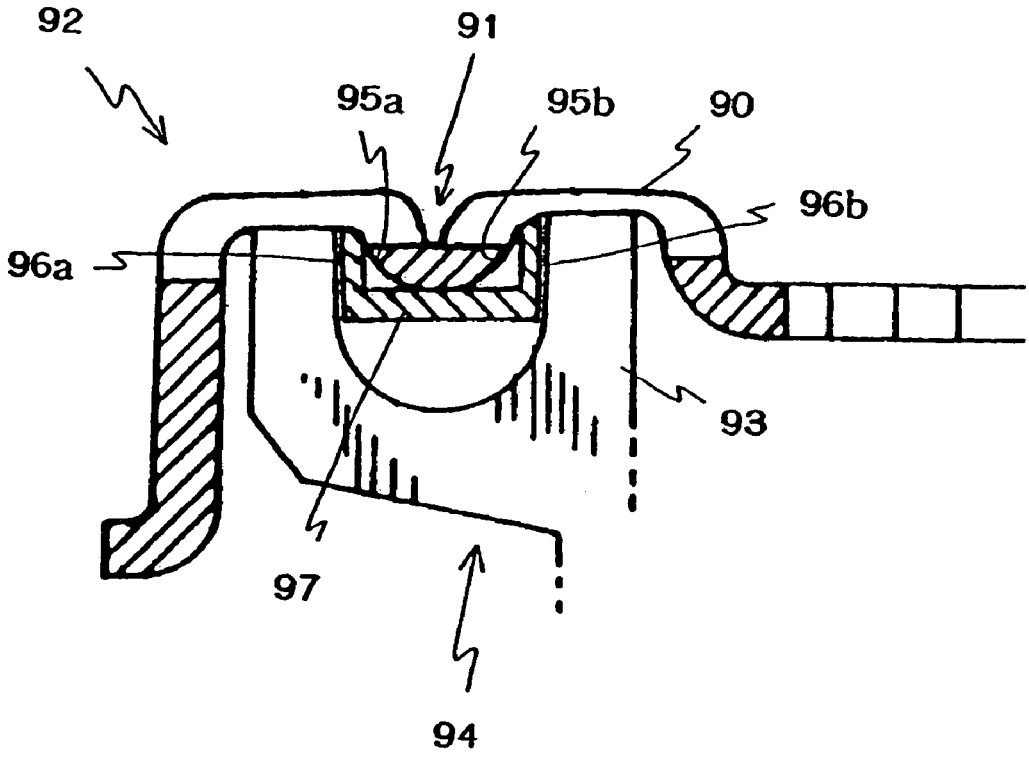
FIG. 11 is an enlarged partial sectional view of the outer and inner cutters of a second embodiment of the electric shaver according to the present invention.

More specifically, as seen from FIG. 11, the present invention is applicable to an electric shaver that includes an outer cutter(s) 92, in which a circularly-demarcating groove 91 is formed in its ring-form shaving surface so that the outer cutter has two concentric shaving surfaces 90 formed in a two-track configuration, and an inner cutter(s) 94, in which a plurality of inner cutter bodies 93 whose tip ends are branched into two sections so that the branched tip ends slide along the inside surfaces of the shaving surfaces 90 of the two-track cutters; and in this type of shaver, an upright member(s) 97 that is movable in the direction perpendicular to the shaving surfaces and whose tip end portion either contact the inside surfaces of the shaving surface or are separated from these inside surfaces is provided on the inside surfaces of the shaving surfaces 90 so as to be between the side walls 95*a* and 95*b* that form the demarcating grooves 91 and the side end surfaces 96*a* and 96*b* of the branched inner cutter bodies 93 that face these side walls 95*a* and 95*b*. Furthermore, the arrangement of the present invention can be used in cases where the shaving surfaces are formed with three or more tracks.

Figure 12A:
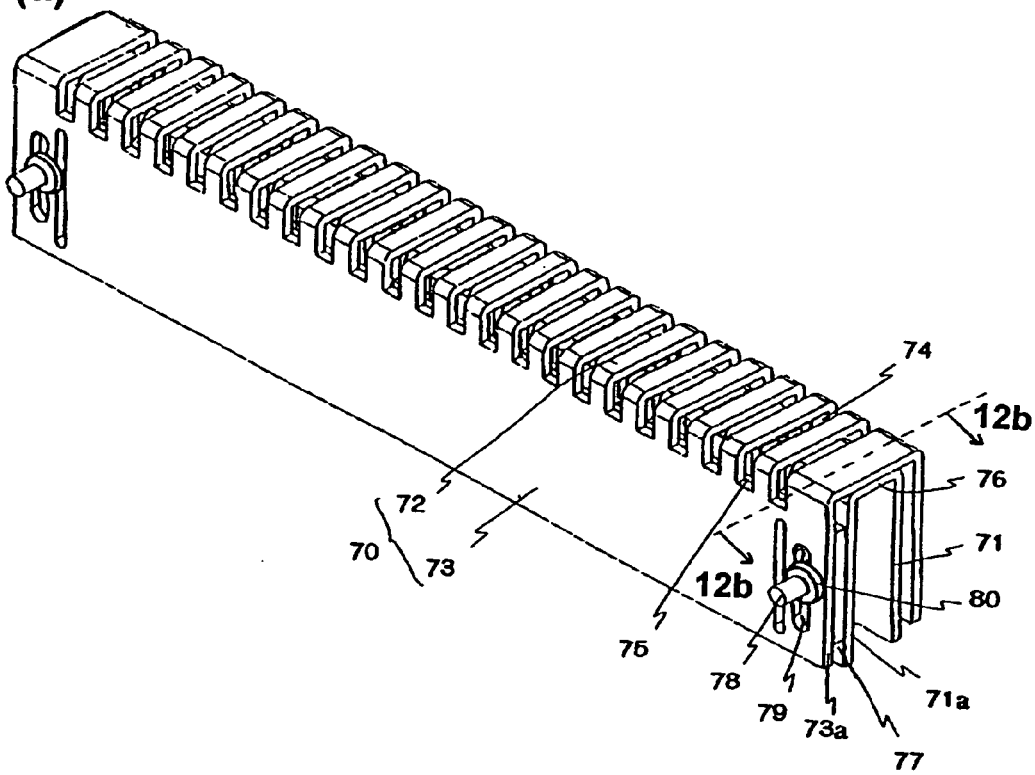
FIG. 12(*a*) shows an outer cutter of another embodiment of the reciprocating type electric shaver according to the present invention, FIG. 12(*b*) showing the section taken along the lines 12*b*—12*b* in FIG. 12(*a*)
Figure 12B:
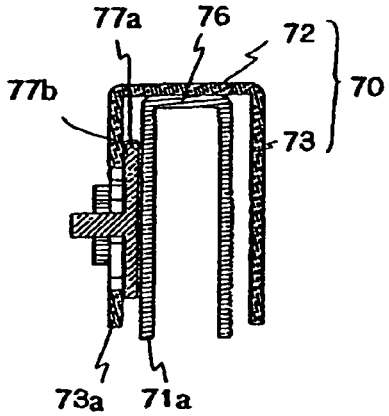

FIGS. 12(*a*) and 12(*b*) shows another embodiment of the electric shaver of the present invention which is a reciprocating type electric shaver. FIG. 12(*a*) shows in a perspective view the cutter unit comprising of an outer cutter 70 and an inner cutter 71, and FIG. 12(*b*) shows the section taken along the line 12*b*—12*b* in FIG. 12(*a*).

The outer cutter 70 of the electric shaver of this embodiment comprises a plate-form shaving surface 72 which extends in the direction of length of the outer cutter 70, and a pair of side walls 73 which are in continuous to the long side edges of the shaving surface 72. The outer cutter 70 is substantially in an inverted U shape. A plurality of slit-form hair introduction openings 74 that extend in the short direction of the shaving surface 72 are formed in the shaving surface 72. Furthermore, a plurality of corner slits 75 that communicate with the hair introduction openings 74 are formed in both of the side walls 73 so as to be close to the shaving surface 72.

The inner cutter 71 provided inside the outer cutter 70. The inner cutter 71 includes a plurality of inner cutter bodies 75 and is formed in a substantially U-shaped cross-sectional shape with a width that is narrower than the width of the outer cutter 70. The inner cutter 71 is caused to make a reciprocating motion with a specified stroke width in the direction of length of the shaving surface 72 by an inner cutter drive shaft (not shown) which is provided inside the main body housing (not shown) of the shaver.

An upright member 77 is disposed between one of the side walls 73*a* of the outer cutter 70 and the side end surface 71*a* of the inner cutter 71 that faces this side wall 73*a*. The upright member 77 is in the shape of plate that extends along the side wall 73*a*, and the thickness of the upright member 77 is set so that the inner surface 77*a* thereof is spaced from the side end surface of the inner cutter 71, and the outer surface 77*b* is in contact with the side wall 73*a*.

Engaging projection 78 that protrudes toward the side wall 73*a* is, as seen from FIG. 12(*b*), disposed on each end of the outer surface 77*b* of the upright member 77, and the upright member 77 is attached to the outer cutter 70 by being fastened by engagement fasteners 80 to engaging holes 79 formed in the side wall 73*a*. Since the engaging holes 79 are formed as slots that extend in the direction of height (i.e., the direction perpendicular to the shaving surface 72), it is possible to make a positional adjustment with respect to the direction of height.

In use, when the upright member 77 that is provided inside the outer cutter 70 in the above-described construction is set so that the tip (upper) end portion 77*c* protrudes further toward the shaving surface 72 of the outer cutter 70 than the end portions of the corner slits 75, then the upright member 77 acts as a shaver burn preventing member that prevents soft portions of the skin from intruding through the corner slits 75 and being injured. When the upright member 77 is set so that the tip (upper) end portion 77*c* is in contact with the inside surface of the shaving surface 72 of the outer cutter 70, then the upright member 77 acts as a hair raising member that raises hair.

As seen from the above, in the electric shaver of the present invention, upright members which rise in the direction perpendicular to the shaving surfaces of a (rotary or reciprocating type) shaver are disposed in the vicinity of the end edges on the outer circumferential sides and/or inner circumferential sides of the inner cutter bodies of an inner cutter. Accordingly, hair that is in a horizontal attitude is reliably cut to a short length. In addition, the intrusion of the skin into the insides of the shaving surfaces can be prevented, so that shaver burn is prevented.

The invention claimed is:

1. An electric shaver comprising:

a cutter frame, an outer cutter provided in said cutter frame, said outer cutter including a shaving surface having hair introduction openings, a side wall formed in continuous to said shaving surface, and corner slits formed in said side wall so as to communicate with said hair introduction openings, and an inner cutter formed with a plurality of inner cutter bodies that make sliding contact with an inside surface of said shaving surface of said outer cutter;

said electric shaver further comprising at least one non-rotating upright member which is provided, between said side wall and side end surfaces of said inner cutter bodies that face said side wall, in an upright attitude in a direction substantially perpendicular to said shaving surface of said outer cutter, said upright member being provided so that a tip end portion thereof can be adjusted to protrude further toward said shaving surface than end portions of said corner slits.

2. The electric shaver according to claim 1, wherein said upright member is provided on said outer cutter so that said tip end portion can be adjusted to protrude further toward said shaving surface than said end portions of said corner slits.

3. The electric shaver according to claim 2, wherein said tip end portion of said upright member is in contact with said inside surface of said shaving surface of said outer cutter.

4. The electric shaver according to claim 1, wherein said upright member is provided so that said tip end portion thereof said is positinally adjustable in a direction perpendicular to said shaving surface.

5. The electric shaver according to claim 1, wherein said upright member is provided so as to be raised and lowered with respect to said outer cutter in a direction perpendicular to said shaving surface, and said upright member is provided so that said tip end portion of said upright member protrudes further toward said shaving surface than said end portions of said corner slits when said upright member is raised.

6. The electric shaver according to claim 5, wherein said outer cutter and said inner cutter are disposed so as to be raised and lowered with respect to said cutter frame; and said upright member is disposed so that:

said tip end portion of said upright member is separated from said shaving surface of said outer cutter when said outer cutter is raised with respect to said cutter frame, and said tip end portion of said upright member is in contact with said inside surface of said shaving surface when said outer cutter is lowered with respect to said cutter frame.

7. An electric shaver comprising:

a cutter frame, an outer cutter provided in said cutter frame, said outer cutter including a shaving surface having hair introduction openings, a side wall formed in continuous to said shaving surface, and corner slits formed in said side wall so as to communicate with said hair introduction openings, and an inner cutter formed with a plurality of inner cutter bodies that make sliding contact with an inside surface of said shaving surface of said outer cutter;

said electric shaver further comprising at least one upright member which is provided, between said side wall and side end surfaces of said inner cutter bodies that face said side wall, in an upright attitude in a direction substantially perpendicular to said shaving surface of said outer cutter, said upright member being provided so that a tip end portion thereof can be adjusted to protrude further toward said shaving surface than end portions of said corner slits, wherein said upright member is provided so as to be raised and lowered with respect to said outer cutter in a direction perpendicular to said shaving surface, said upright member is provided so that said tip end portion of said upright member protrudes further toward said shaving surface than said end portions of said corner slits when said upright member is raised, said outer cutter and said inner cutter are disposed so as to be raised and lowered with respect to said cutter frame;

said upright member is disposed so that:

said tip end portion of said upright member is separated from said shaving surface of said outer cutter when said outer cutter is raised with respect to said cutter frame, and said tip end portion of said upright member is in contact with said inside surface of said shaving surface when said outer cutter is lowered with respect to said cutter frame, said upright member is provided on said outer cutter with an elastic member in between, and said tip end portion of said upright member comes in contact with said inside surface of said shaving surface as a result of deformation of said elastic member that occurs when said outer cutter is lowered with respect to said cutter frame.

8. The electric shaver according to claim 4, 5, 6 or 7, wherein a positional adjustment of said upright member is accomplished in steps.

9. An electric shaver according to any one of claims 1 through 7, wherein said outer cutter is comprised of said shaving surface formed in a ring-form shape, an outside wall formed in continuous to an outer circumferential edge of said shaving surface, an inside wall formed in continuous to an inner circumferential edge of said shaving surface, and outer circumference side corner slits and inner circumference side corner slits which communicate with said hair introduction openings and are respectively formed in said outside wall and inside wall; and said upright member is disposed at least one of between said outside wall and outer circumference side end surfaces of said inner cutter bodies and between said inside wall and inner circumference side end surfaces of said inner cutter bodies.

* * * * *